US008708589B2

(12) United States Patent
Mitsuhashi et al.

(10) Patent No.: US 8,708,589 B2
(45) Date of Patent: Apr. 29, 2014

(54) TRANSPORT DEVICE, RECORDING APPARATUS, TRANSPORT METHOD

(75) Inventors: Masato Mitsuhashi, Hara-mura (JP); Sumito Anzai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 183 days.

(21) Appl. No.: 13/216,994

(22) Filed: Aug. 24, 2011

(65) Prior Publication Data

US 2012/0048079 A1 Mar. 1, 2012

(30) Foreign Application Priority Data

Aug. 26, 2010 (JP) ..... 2010-189190

(51) Int. Cl.
*B41J 11/66* (2006.01)
*B41J 11/70* (2006.01)

(52) U.S. Cl.
USPC ..... 400/612

(58) Field of Classification Search
USPC ..... 400/621
See application file for complete search history.

(56) References Cited

U.S. PATENT DOCUMENTS 4,353,274 A 10/1982 Shimizu
5,437,512 A * 8/1995 Gull ..... 400/621
6,773,180 B2 * 8/2004 Tsuji et al. ..... 400/608.4
2006/0039738 A1 * 2/2006 Murata et al. ..... 400/615.2
2009/0245913 A1 * 10/2009 Yamamoto ..... 400/621
2011/0052301 A1 * 3/2011 Crystal et al. ..... 400/621
2011/0158736 A1 * 6/2011 Kosuge ..... 400/621

FOREIGN PATENT DOCUMENTS

EP 1498774 A1 7/2004
JP 01234276 A * 9/1989 ..... B41J 11/66
JP 07101120 A * 4/1995 ..... B41J 11/70
JP 08-091658 A 4/1996
JP 08-091658 9/1996
JP 11277821 A * 10/1999 ..... B41J 11/66
JP 2003260832 A * 9/2003 ..... B41J 11/70
JP 2003-326493 A 11/2003
JP 2004291219 A * 10/2004 ..... B41J 11/70
JP 2004291603 A * 10/2004 ..... B41J 11/70
JP 2009073062 A * 4/2009 ..... B41J 11/70

OTHER PUBLICATIONS

European Search Report dated May 7, 2013 in application No. 11178611.7.

* cited by examiner

*Primary Examiner* — Nguyen Ha
(74) *Attorney, Agent, or Firm* — Maschoff Brennan

(57) ABSTRACT

The transport control section controls, at the time of cutting of the long sheet by the cutting unit, the motor for pinching such that a downstream portion in the transport direction, which is cut from the sheet, remains pinched by the first roller and the second roller at the point of time of completion of cutting, and controls, after the completion of cutting, the motor for discharge such that the downstream portion is discharged downstream in the transport direction by rotation of the respective rollers which pinch the downstream portion.

12 Claims, 6 Drawing Sheets

TRANSPORT DEVICE, RECORDING APPARATUS, TRANSPORT METHOD

CROSS REFERENCES TO RELATED APPLICATIONS

The entire disclosure of Japanese Patent Application No. 2010-189190, filed Aug. 26, 2010 is expressly incorporated herein by reference.

BACKGROUND

1. Technical Field

The present invention relates to a transport device and a transport method, which transport a medium from an upstream side in a transport direction to a downstream side. Also, the invention relates to a recording apparatus which carries out recording on the medium that is transported by the transport device.

2. Related Art

One example of a recording apparatus which is provided with a recording section that carries out recording with respect to a medium that is transported in a transport direction is described in JP-A-8-91658. That recording apparatus is provided with a transport device which feeds a long sheet (medium) wound on a shaft member while rotating the shaft member. In such a transport device, a plurality of rollers which are disposed along the transport direction, a cutting section having a cutter which is disposed further downstream than the recording section in the transport direction, and a baffle which is disposed further downstream in the transport direction than the cutting section are provided.

In the recording apparatus having a sheet cutting function in this manner, a process is performed where a portion (hereinafter also referred to as a "recorded portion") of the long sheet on which recording has been carried out is cut. Specifically, in a case where the recorded portion has moved up downstream in the transport direction further than the cutting section, the recorded portion is nipped by the baffle after transport of the sheet is temporarily stopped. The cutting section is driven in this state, whereby the recorded portion is cut from the long sheet. Thereafter, the transport of the sheet is restarted after nipping of the recorded portion by the baffle is cancelled.

In the above-described method, there is a problem in that it is necessary to provide the baffle, the necessity of which is low in terms of transport of the sheet, so that the number of components increases.

Further, in a case where a portion (in this case, the recorded portion) of the sheet is nipped by the baffle, it is necessary to completely stop transport of the sheet. Also, in a case where cutting of the sheet has been completed, after nipping of the recorded portion by the baffle is cancelled, a transport section such as a roller for discharge is made to be driven in order to discharge the recorded portion. That is, while the recorded portion is nipped by the baffle, it is not possible to drive a discharge section in order to discharge the recorded portion. For this reason, in the recording apparatus having a sheet cutting function, there is room for improvement in terms of improvement of the discharge speed of the portion cut from the sheet.

BRIEF SUMMARY OF THE INVENTION

An advantage of some aspects of the invention is that it provides a transport device, a recording apparatus, and a transport method, in which it is possible to improve the discharge speed of a downstream portion in a transport direction cut from a medium while suppressing an increase in the number of components.

A first aspect of the invention is a transport device including a cutting section which cuts a medium that is transported along a transport direction, a discharge section which discharges a downstream portion in the transport direction which has been cut from the medium by the cutting section downstream in the transport direction, and a transport control section which controls the cutting section and the discharge section, wherein the discharge section includes a first roller which is disposed at the bottom surface of the medium, a second roller which is disposed at the top surface of the medium, a driving source which generates a driving force for relatively moving the respective rollers in a direction of making the respective rollers approach each other and a direction of making the respective rollers be separated from each other, and a motor for discharge which generates a driving force for rotating the respective rollers that are in the approached state, and the transport control section controls, at the time of cutting of the medium by the cutting section, the driving source such that the downstream portion which is cut from the medium remains pinched by the respective rollers at the point of time of the completion of cutting, and controls the motor for discharge such that the downstream portion is discharged downstream in the transport direction by rotation of the respective rollers which pinch the downstream portion, after the completion of cutting.

According to the above configuration, the downstream portion which is cut from the medium by the cutting section is pinched by the first and second rollers which are located further downstream in the transport direction than the cutting section. The respective rollers are used not only for pinching the medium at the time of cutting, but also for transporting the medium downstream in the transport direction. For this reason, compared to the existing case where a baffle for pinching the medium is provided separately from the first roller and the second roller, an increase in the number of components of the transport device can be suppressed.

Further, after cutting processing, the downstream portion cut from the medium can be discharged by rotating the respective rollers which pinch the downstream portion. Currently, in the apparatuses currently known in the art, when the downstream portion is pinched by a baffle, it is necessary to discharge the downstream portion after pinching of the downstream portion by the baffle is cancelled. In contrast to this, in the invention, there is no need to cancel pinching of the downstream portion by the respective rollers. For this reason, the processing of cancelling pinching of the downstream portion cut from the medium is not needed, so that the downstream portion can be rapidly discharged correspondingly. Therefore, it is possible to improve the discharge speed of the downstream portion in the transport direction cut from the medium while suppressing an increase in the number of components.

In the transport device according to the above aspect of the invention, it is preferable that the cutting section include a blade section which moves from one end in the width direction of the medium to the other end, thereby cutting the medium, and that the transport control section control, at the time of cutting of the medium by the cutting section, controls the driving source such that the respective rollers that are in the separated state relatively move in a direction of making the respective rollers approach each other after the start of movement of the blade section and also such that pinching of the downstream portion by the respective rollers is completed at the point of time when a midway position which is between one end in the width direction of the medium and the other end is cut by the blade section.

At the time of cutting of the medium, a stress in the width direction is imparted to the downstream portion at the point of time when the other end in the width direction of the medium is cut, that is, at the point of time when the downstream portion is cut from the medium. As a result, if the downstream portion does not remain pinched by the respective rollers, unintended movement in the width direction of the downstream portion sometimes occurs due to the stress. Therefore, in the invention, at the point of time when the midway position in the width direction of the medium has been cut, at least one of the timing of relative movement and the speed of the respective rollers is adjusted such that pinching of the medium by the respective rollers is completed. For this reason, generation of the unintended movement in the width direction of the downstream portion cut from the medium due to the stress which is imparted at the time of cutting can be suppressed.

Here, in a case where recording has been carried out on the medium by a recording section or the like, fluid remains attached to at least one of the surface and the back of the medium. Then, from the viewpoint of quality maintenance of a recorded matter, it is preferable to make the contact time of the roller or the like with the portion with the fluid attached thereto of the medium as short as possible. In this regard, in the invention, compared to a case where the medium is pinched by the respective rollers from before cutting of the medium is started, the time when the medium is pinched by the respective rollers can be shortened. Accordingly, even if the transport device according to the invention is mounted on a recording apparatus, deterioration of recording quality in the recording apparatus can be suppressed.

In the transport device according to the above aspect of the invention, it is preferable that the transport control section adjust, at the time of cutting of the medium by the cutting section, the timing of the stop of control of the motor for discharge and the timing of the start of control of the driving source such that rotation of the first roller is stopped before pinching of the downstream portion by the respective rollers is completed.

If a tensile force downstream in the transport direction is imparted to the downstream portion which is pinched by the respective rollers, there is concern that due to the tensile force, it may not be possible to precisely cut the downstream portion off from the medium. That is, there is concern that the shape of the downstream portion cut from the medium may become different from a desired shape. In this regard, in the invention, in a case where the downstream portion has been pinched by the respective rollers, a force of transporting the downstream portion downstream in the transport direction is not imparted to the downstream portion. That is, a tensile force downstream in the transport direction is not imparted to the downstream portion which is pinched by the respective rollers. For this reason, it is possible to precisely cut the downstream portion from the medium.

In the transport device according to the above aspect of the invention, it is preferable that the transport control section control, at the time of cutting of the medium by the cutting section, the driving source such that relative movement of the respective rollers that are in the separated state in a direction of approaching each other is started at the point of time when control of the motor for discharge is stopped or after that point of time.

According to the above configuration, a possibility that the tensile force downstream in the transport direction may be imparted to the downstream portion which is pinched by the respective rollers can be reduced.

It is preferable that the transport device according to the above aspect of the invention further include a transport section which includes a transport roller that is disposed further at upstream in the transport direction than a cutting position by the cutting section in the medium and a transport motor which generates a driving force for rotating the transport roller, wherein the transport control section controls the transport motor, at the time of cutting of the medium by the cutting section, such that rotation of the transport roller is stopped before the start of driving of the cutting section and the transport roller rotates so as to restart transport of the medium, after the completion of cutting.

According to the above configuration, in a case where the medium is cut, since rotation of the transport roller remains stopped, imparting of a force pushing the medium downstream in the transport direction to the medium is avoided. For this reason, imparting of a force which is unnecessary for cutting to the medium which is cut can be avoided and it is possible to precisely cut the downstream portion from the medium.

A second aspect of the invention is a recording apparatus including the above-described transport device, a recording section which attaches fluid to the medium, and a recording control section which controls the recording section so as to stop recording processing using the fluid, at the time of cutting of the medium by the cutting section.

According to the above configuration, the downstream portion of the medium, on which recording has been finished, can be rapidly discharged, so that the throughput of the recording apparatus can be improved.

A third aspect of the invention is a transport method that cuts a downstream portion in a transport direction of a medium which is transported from upstream in the transport direction downstream, downstream portion being cut from the medium by a cutting section and discharges the cut downstream portion from the medium further downstream in the transport direction, wherein a first roller which is disposed at the bottom surface of the medium and a second roller which is disposed at the top surface of the medium are provided further downstream in the transport direction than the cutting section, and the respective rollers are made to relatively move in a direction of approaching each other and a direction of being separated from each other. The method includes relatively moving, at the time of cutting of the medium by the cutting section, the respective rollers that are in the separated state in a direction of making the respective rollers approach each other such that the downstream portion which is cut from the medium remains pinched by the respective rollers at the point of time of the completion of cutting; and discharging the downstream portion downstream in the transport direction by rotating the respective rollers which pinch the downstream portion, after the completion of cutting.

According to the above configuration, the operation and the advantageous effects equivalent to those of the above-described transport device can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, one embodiment embodying the invention will be described on the basis of FIGS. 1 to 6.

Figure 1:
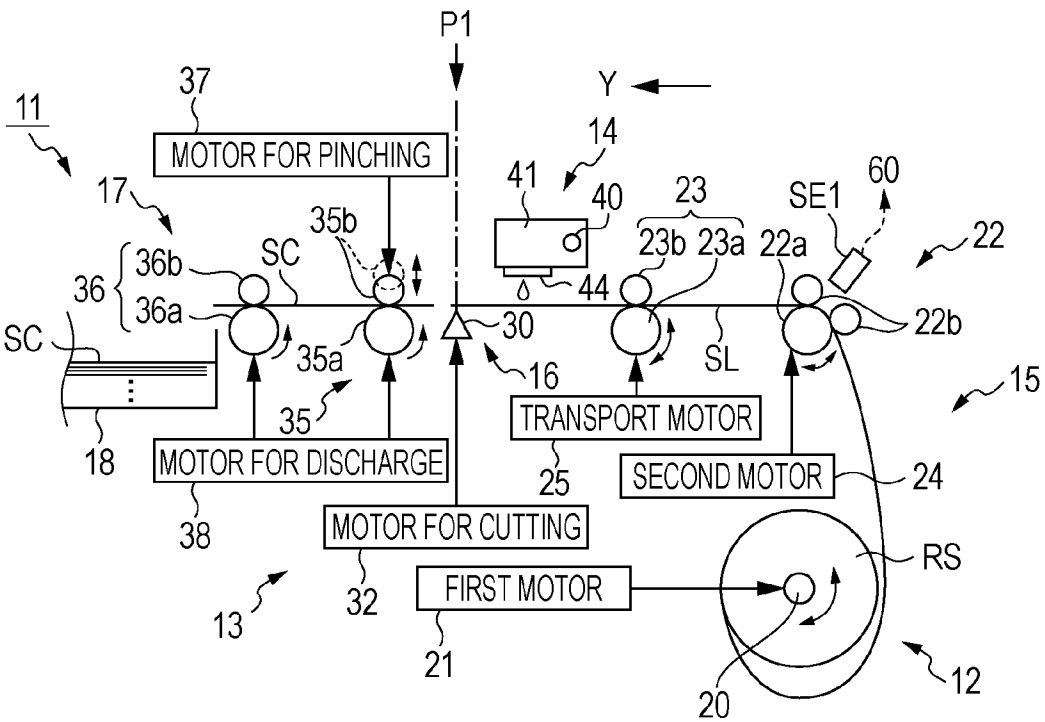
FIG. 1 is a side view schematically illustrating a recording apparatus of an embodiment of the invention.

As shown in FIG. 1, a recording apparatus 11 of this embodiment is an ink jet printer of a serial type. Such a recording apparatus 11 includes a housing section 12 which houses a long sheet SL as one example of a medium comprising a rolled paper RS wound in a roll form, and a transport device 13 which transports the long sheet SL by incrementally feeding it from the inside of the housing section 12. Also, a recording unit 14 as one example of a recording section which carries out recording with respect to the long sheet SL is provided at a midway position in a transport direction Y (also referred to as a "sub-scanning direction") of the long sheet SL.

The transport device 13 includes a transport unit 15 as one example of a transport section which transports the long sheet SL from upstream (the housing section 12 side) in the transport direction Y further downstream (toward the recording unit 14 side). Further, in the transport device 13, a cutting unit 16 is provided and serves as one example of a cutting section which cuts the long sheet SL at a cutting position P1 which is downstream (in FIG. 1, the left side) in the transport direction Y from the recording unit 14. The cutting unit 16 cuts a recorded portion (a downstream portion) SC, in which recording is finished in the long sheet SL, from the long sheet SL. Further, downstream in the transport direction Y of the cutting position P1, a discharge unit 17 is provided which comprises one example of a discharge section which discharges the recorded portion SC cut from the long sheet SL to a discharge tray 18 which is located at the most downstream side in the transport direction Y.

The rolled paper RS of this embodiment is made by winding the long sheet SL on a shaft member 20 which extends in a scanning direction (in this embodiment, it is a direction perpendicular to the plane of paper and is also referred to as a "main scanning direction") perpendicular to the transport direction Y. In a case where the rolled paper RS has been set in the housing section 12, a first motor 21 is connected to the shaft member 20 in a power-transmittable state. Then, if a driving force from the first motor 21 is transmitted to the shaft member 20, the shaft member 20 rotates in a given direction and as a result, the rolled paper RS is sent out as the long sheet SL along a transport path from the housing section 12.

Next, a description will be made with respect to the transport unit 15.

As shown in FIG. 1, the transport unit 15 includes a feeding section 22 for incrementally feeding the long sheet SL from the inside of the housing section 12, and a transport roller pair 23 which is disposed downstream in the transport direction Y from the feeding section 22. The feeding section 22 includes a feeding roller 22*a* which is disposed at the bottom surface of the long sheet SL, and a driven roller 22*b* which is disposed at the top surface of the long sheet SL. That is, the driven roller 22*b* is disposed facing the feeding roller 22*a* with the long sheet SL interposed therebetween. A second motor 24 is connected to the feeding roller 22*a* in a power-transmittable state. Then, in a case where a driving force from the second motor 24 is transmitted to the feeding roller 22*a*, the feeding roller 22*a* rotates and the driven roller 22*b* is also driven and rotated following the rotation of the feeding roller 22*a*. As a result, the long sheet SL is sent downstream in the transport direction Y by the feeding section 22.

The transport roller pair 23 includes a transport roller 23*a* and a driven roller 23*b*, which are disposed facing each other with the long sheet SL interposed therebetween and which also pinch the sheet SL. As one example, the transport roller 23*a* is disposed at the bottom surface of the long sheet SL and the driven roller 23*b* is also disposed at the top surface of the long sheet SL. A transport motor 25 is connected to the transport roller 23*a* in a power-transmittable state. Then, in a case where a driving force from the transport motor 25 is transmitted to the transport roller 23*a*, the transport roller 23*a* rotates and the driven roller 23*b* is also driven and rotated following the rotation of the transport roller 23*a*. As a result, the long sheet SL is sent downstream in the transport direction Y by the transport roller pair 23.

In addition, a detection sensor SE1 for detecting the leading end of the long sheet SL is provided further at upstream in the transport direction Y than the transport roller pair 23. A detection signal from the detection sensor SE1 is output to a control device 60 which controls the recording apparatus 11.

Next, a description will be made with respect to the cutting unit 16.

Figure 2:
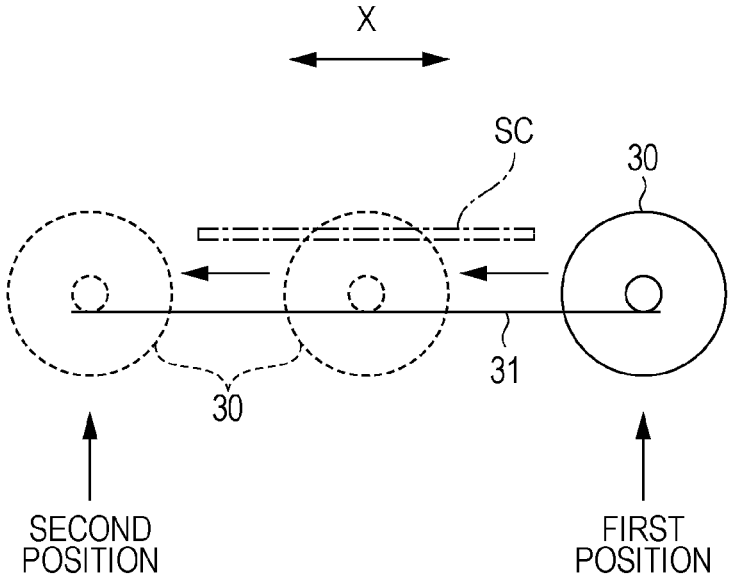
FIG. 2 is a schematic diagram illustrating a cutting unit.

As shown in FIGS. 1 and 2, the cutting unit 16 includes an approximately disc-shaped cutter 30 as one example of a blade section. Further, a guide member 31 extending in a scanning direction X is provided at the lower side of the long sheet SL (in FIG. 2, shown by a dashed-dotted line) in FIG. 2, and the guide member 31 supports the cutter 30 in a state where the cutter can move in the scanning direction X. A portion (in FIG. 2, an upper end portion) of the cutter 30 that is supported on the guide member 31 is located above the long sheet SL. Then, the cutter 30 moves while being guided by the guide member 31 between a first position that is located at one end in the width direction (the scanning direction X) of the long sheet SL and a second position that is located at the other end in the width direction (the scanning direction X).

Also, a motor for cutting 32 is connected to the cutter 30 in a power-transmittable state. Then, in a case where a driving force from the motor for cutting 32 is transmitted to the cutter 30, the cutter 30 is moved along the scanning direction X by being guided by the guide member 31. That is, the cutter 30 moves from the first position to the second position (or, from the second position to the first position), whereby the long sheet SL is gradually cut from one end in the width direction thereof to the other end.

Next, a description will be made with respect to the discharge unit 17.

As shown in FIG. 1, the discharge unit 17 includes a plurality of (in this embodiment, two) discharge roller pairs 35 and 36 which is disposed along the transport direction Y. Among the discharge roller pairs 35 and 36, the second discharge roller pair 36 which is disposed downstream in the transport direction Y includes a driving roller 36*a* and a driven roller 36*b*, which pinch the recorded portion SC. As one example, the driving roller 36*a* is disposed at the bottom surface of the recorded portion SC and the driven roller 36*b* is also disposed at the top surface of the recorded portion SC.

Further, among the respective discharge roller pairs 35 and 36, the first discharge roller pair 35 which is disposed at upstream in the transport direction Y includes a first roller 35*a* and a second roller 35*b*, which are disposed facing each other with the recorded portion SC interposed therebetween. As one example, the first roller 35*a* is disposed at the bottom surface of the recorded portion SC and the second roller 35*b* is also disposed at the top surface of the recorded portion SC. Further, a motor for pinching 37 as one example of a driving source is connected to the second roller 35*b* in a power-transmittable state. Then, the second roller 35*b* moves in a direction in which it approaches the first roller 35*a* and a direction in which it is separated from the first roller 35*a* (in FIG. 1, the up-and-down direction) by a driving force from the motor for pinching 37. That is, in a case where the second roller 35*b* has moved in a direction in which it is relatively separated with the first roller 35*a* as a standard, that is, in a case where the second roller 35*b* is located at a position shown by a dashed line in FIG. 1, the first discharge roller pair 35 cannot pinch the recorded portion SC. On the other hand, in a case where the second roller is located at a position shown by a solid line in FIG. 1, the first discharge roller pair 35 can pinch the recorded portion SC.

Further, a motor for discharge 38 is connected in a power-transmittable state to the first roller 35*a* and the driving roller 36*a*, which are located at the bottom surface of the recorded portion SC, among the discharge roller pairs 35 and 36. Then, if a driving force from the motor for discharge 38 is transmitted to the driving roller 36*a* and the first roller 35*a*, the recorded portion SC is discharged downstream in the transport direction Y by the respective discharge roller pairs 35 and 36.

Next, a description will be made with respect to the recording unit 14.

Figure 3:
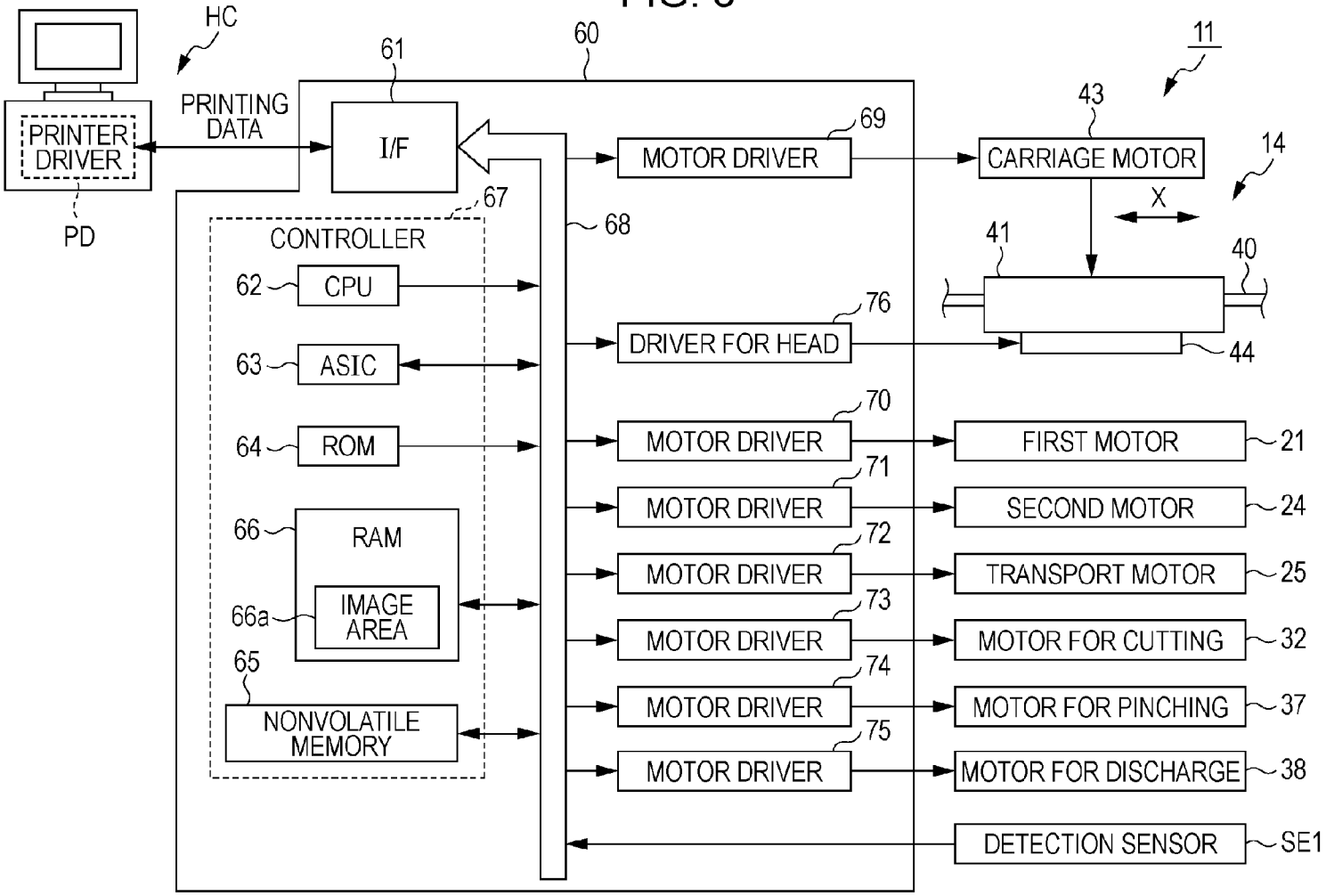
FIG. 3 is a block diagram illustrating a main section of the electrical configuration of the recording apparatus.

As shown in FIGS. 1 and 3, the recording unit 14 includes a guide shaft 40 that extends in the scanning direction X (in FIG. 1, a direction perpendicular to the plane of paper) perpendicular to the transport direction Y. The guide shaft 40 is supported at both ends in the longitudinal direction thereof on a main body case (not shown) of the recording apparatus 11 and is also disposed at the top surface (in FIG. 1, the upper side) of the long sheet SL. A carriage 41 is connected to such a guide shaft 40 in a state where it can reciprocate along the longitudinal direction (that is, the scanning direction X) of the guide shaft 40. The carriage 41 moves along the scanning direction X on the basis of a driving force which is transmitted from a carriage motor 43.

Further, the carriage 41 supports a recording head 44. Ink as one example of fluid is supplied to the recording head 44 from an ink cartridge (not shown) mounted on a holder section (not shown) of the recording apparatus 11 in a detachable state. A plurality of nozzles (not shown) and driving elements correlated with the respective nozzles are provided at such a recording head 44. Then, by driving of a corresponding driving element, ink is ejected from the nozzle toward the surface (in FIG. 1, the upper face) of the long sheet SL. In addition, a support member (not shown) which supports the long sheet SL is provided at the same position as the recording head 44 in the transport direction Y and at the bottom surface of the long sheet SL.

Next, a description will be made with respect to the electrical configuration of the recording apparatus 11.

As shown in FIG. 3, the recording apparatus 11 is provided with the control device 60 which controls the whole of the recording apparatus 11. The control device 60 is made to be capable of feeding and receiving a variety of information such as printing data between itself and a printer driver PD of a host apparatus HC through an interface 61.

The control device 60 includes a controller 67 having a CPU 62, an ASIC 63 (Application Specific IC), a ROM 64, a nonvolatile memory 65, and a RAM 66. The controller 67 is electrically connected to various drivers 69, 70, 71, 72, 73, 74, 75, and 76 through a bus 68. Then, the controller 67 controls the motors 21, 24, 25, 32, 37, 38, and 43 through the motor drivers 69 to 75 and also individually controls the respective driving elements in the recording head 44 through the driver for head 76.

In the ROM 64, various control programs, various data, and so on are stored. In the nonvolatile memory 65, various programs including a firmware program, various data necessary for printing processing, and so on are stored. An image area 66*a*, in which the printing data received from the host apparatus HC, data during processing of the printing data, and data after the processing are stored, is provided at the RAM 66.

Next, a description will be made with respect to the controller 67 of this embodiment. In addition, in FIG. 4, to facilitate understanding of the explanation of the specification, illustrations of various drivers 69 to 76 are omitted.

Figure 4:
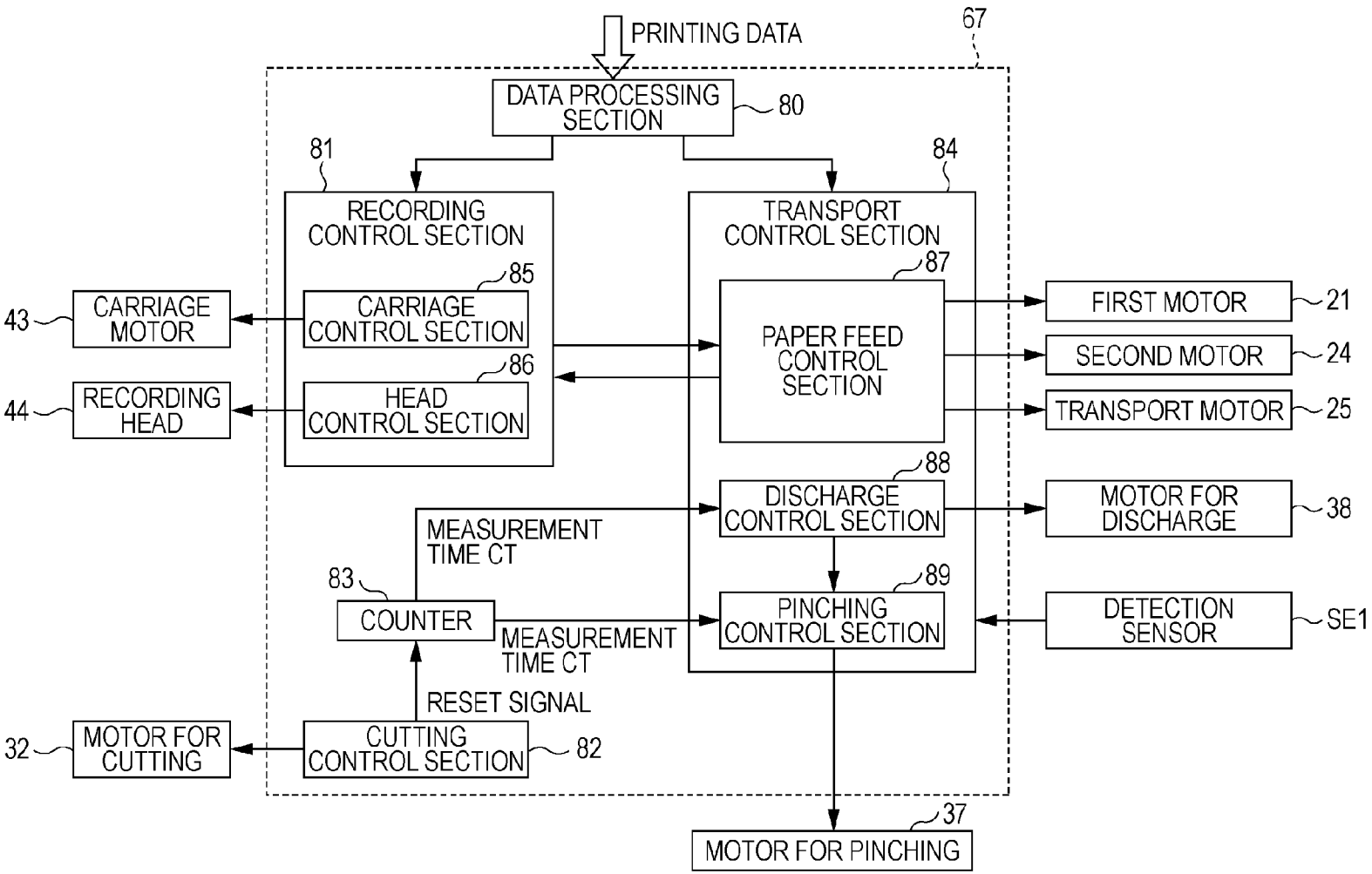
FIG. 4 is a block diagram illustrating a main section of the functional configuration of a controller.

As shown in FIG. 4, the controller 67 includes, as functional sections which are realized by at least one of software and hardware, a data processing section 80, a recording control section 81 as a recording control section, a cutting control section 82, a counter 83, and a transport control section 84 as a transport control section.

The data processing section 80 converts data except for a command among the printing data received through the interface 61 into bitmap data, in which a printing dot is expressed by a gradation value, and then expands the bitmap data. Then, the data processing section 80 generates bitmap data for one pass on the basis of the expanded data and then outputs the bitmap data for one pass to the recording control section 81. In addition, "one pass" refers to one movement of the recording head 44 (that is, the carriage 41) in the scanning direction X accompanied by ink ejection.

Further, the data processing section 80 interprets the command which is included in the printing data received through the interface 61, thereby acquiring a recording mode and the unit transport amount of the long sheet SL, that is, a paper feed amount, at the time of recording processing. Then, the data processing section 80 outputs the information about the acquired recording mode to the recording control section 81 and also outputs the information about the acquired unit transport amount to the transport control section 84. In addition, as the recording mode, a draft printing mode with emphasis on a printing speed and a highly-detailed printing mode with emphasis on printing precision can be given as an example.

The recording control section 81 includes a carriage control section 85 and a head control section 86. The carriage control section 85 sets movement control information such as the movement speed, the movement start position, and the stop position of the carriage 41 at the time of the recording processing on the basis of the recording mode input from the data processing section 80. Then, the carriage control section 85 controls the driving of the carriage motor 43 on the basis of the set movement control information.

The head control section 86 individually controls the driving of the respective driving elements (not shown) which are mounted on the recording head 44, on the basis of the input bitmap data for one pass. That is, in this embodiment, the recording control section 81 carries out recording on the long sheet SL by making movement in the scanning direction X of the carriage 41 and driving of the recording head 44 interlock with each other. Then, if recording for one pass is completed, the recording control section 81 performs output to that effect to the transport control section 84.

The cutting control section 82 controls the driving of the motor for cutting 32 so as to move the cutter 30 from the first position to the second position (or, from the second position to the first position) at the time of cutting of the long sheet SL. If movement of the cutter 30 from the first position to the second position (or, movement from the second position to the first position) is completed, such a cutting control section 82 determines that cutting of the long sheet SL has been completed, and then stops driving of the motor for cutting 32.

Figure 5:
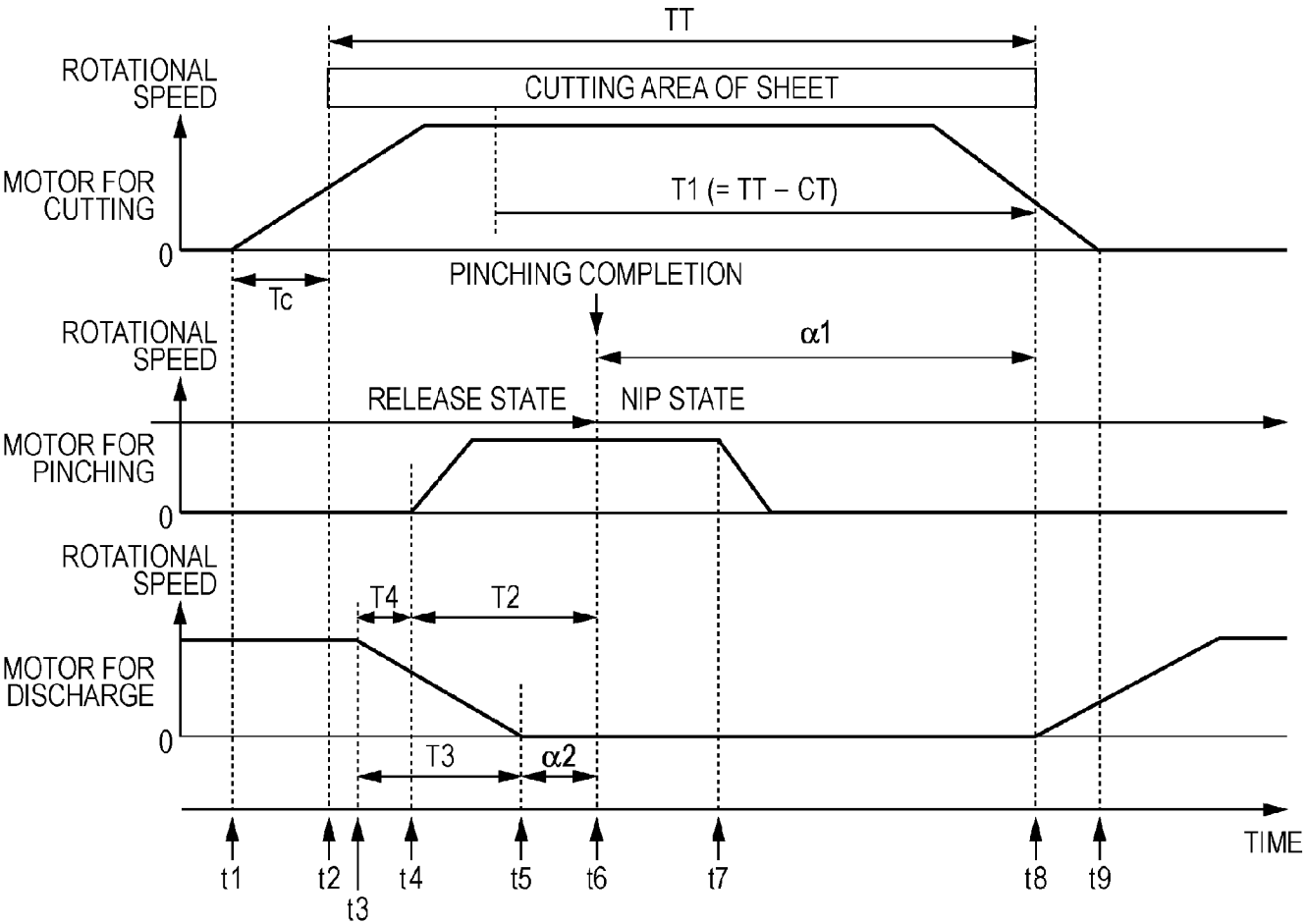
FIG. 5 is a timing chart describing a state of cutting a long sheet.

Also, as shown in the timing chart of FIG. 5, the cutting control section 82 acquires an elapsed time from the point of time of the start of movement (a first timing t1) of the cutter 30 at the time of cutting of the long sheet SL. Then, in a case where the acquired elapsed time has become the preset time threshold Tc, the cutting control section 82 determines that cutting of the long sheet SL by the cutter 30 has actually been started (a second timing t2). At this timing, the cutting control section 82 outputs a reset signal to a counter 83.

As shown in FIG. 4, the counter 83 includes a clock generation circuit (not shown) that generates a periodic signal, that is, a clock signal. Then, the counter 83 updates a measurement time CT which is timed every time a pulse of the generated clock signal is detected. Further, if the reset signal is input from the cutting control section 82, the counter 83 resets the measurement time CT to be "0 (zero)" and performs timing.

To the transport control section 84, the information about the unit transport amount is input from the data processing section 80 and also a detection signal from the detection sensor SE1 is input. Such a transport control section 84 includes a paper feed control section 87, a discharge control section 88, and a pinching control section 89. In a case where the leading end of the long sheet SL has been detected on the basis of the detection signal from the detection sensor SE1, the paper feed control section 87 controls the driving of the first motor 21, the second motor 24, and the transport motor 25, that is, the transport amount of the long sheet SL on the basis of the detection result.

Further, if input to the effect that the recording for one pass has been completed is made from the recording control section 81 at the time of the recording processing, the paper feed control section 87 controls the driving of the transport motor 25 such that the long sheet SL is transported by the unit transport amount. Then, if feed of the long sheet SL is completed, the paper feed control section 87 outputs the effect to the recording control section 81. That is, in this embodiment, feed of the long sheet SL and ejection of ink by the recording head 44 are alternately performed, whereby an image is recorded on the long sheet SL.

The discharge control section 88 controls the driving of the motor for discharge 38 in order to discharge the recorded portion SC cut from the long sheet SL. The discharge control section 88 of this embodiment acquires the measurement time CT from the counter 83 at the time of cutting of the long sheet SL and determines the control stop timing of the motor for discharge 38 on the basis of the measurement time CT. Further, in a case where cutting has been completed, the discharge control section 88 restarts the driving of the motor for discharge 38. Then, the discharge control section 88 acquires the timing when the rear end of the recorded portion SC has moved up downstream in the transport direction Y further than the first discharge roller pair 35, on the basis of the amount of driving of the motor for discharge 38 and then outputs the effect to the pinching control section 89.

The pinching control section 89 controls the driving of the motor for pinching 37. That is, the pinching control section 89 acquires the measurement time CT from the counter 83 at the time of cutting of the long sheet SL and determines the driving start timing of the motor for pinching 37 for pinching the long sheet SL by the first discharge roller pair 35, on the basis of the measurement time CT. Further, if input to the effect that the rear end of the recorded portion SC has moved further downstream in the transport direction Y than the first discharge roller pair 35 is from the discharge control section 88, the pinching control section 89 controls the driving of the motor for pinching 37 so as to move the second roller 35*b* in a direction of making it be separated from the first roller 35*a*.

Next, a cutting method of the long sheet SL in the recording apparatus 11 of this embodiment will be described on the basis of the timing chart shown in FIG. 5.

As shown in the timing chart of FIG. 5, if the rear end in the transport direction Y of the recorded portion SC moves up to the cutting position P1, transport of the long sheet SL by the transport unit 15 is stopped. That is, driving of the transport motor 25 is stopped before cutting of the long sheet SL by the cutter 30 is started. Then, if an elapsed time from the first timing t1 when movement of the cutter 30 has been started becomes the time threshold Tc, cutting of the long sheet SL by the cutter 30 is started (the second timing t2). At this point of time, the motor for discharge 38 is being driven, so that discharge of the recorded portion SC by the discharge unit 17 is performed. At this time, a tensile force downstream in the transport direction Y is imparted to the recorded portion SC which is cut from the long sheet SL, by the discharge unit 17 (specifically, the second discharge roller pair 36). However, just after the start of cutting of the long sheet SL by the cutter 30, since the amount of cutting of the long sheet SL by the cutter 30 is small, the long sheet SL is not broken by the action of the tensile force.

Further, at the second timing t2, driving of the motor for pinching 37 remains stopped and the second roller 35*b* remains separated from the first roller 35*a*. That is, the recorded portion SC is not pinched by the first discharge roller pair 35. In addition, in this embodiment, a state where the recorded portion SC is not pinched by the first discharge roller pair 35 is called a "release state" and a state where the recorded portion SC is pinched by the first discharge roller pair 35 is called a "nip state".

Then, at a third timing t3 after the second timing t2 when cutting of the long sheet SL by the cutter 30 is started, control of the motor for discharge 38 is stopped. Then, the rotational speed of the motor for discharge 38 gradually becomes a low speed. Then, from a fourth timing t4 prior to a fifth timing t5 when the rotational speed of the motor for discharge 38 becomes "0 (zero)", driving of the motor for pinching 37 is started. That is, in the first discharge roller pair 35, approximation of the second roller 35*b* to the first roller 35*a* is started.

Then, at a sixth timing t6 after the fifth timing t5, the first discharge roller pair 35 enters the nip state, and at a subsequent seventh timing t7, driving of the motor for pinching 37 is stopped. Further, at an eighth timing t8 after the seventh timing t7, cutting of the long sheet SL by the cutter 30 is completed, and at a subsequent ninth timing t9, the rotational speed of the motor for cutting 32 becomes "0 (zero)".

In this embodiment, a first margin time $\alpha 1$ is set such that at the second timing t2, the first discharge roller pair 35 is in the release state, while at the eighth timing t8, the first discharge roller pair 35 is in the nip state. The first margin time $\alpha 1$ is set to be a time shorter than a time from the second timing t2 to the eighth timing t8, that is, a time required for cutting TT which is required for cutting of the long sheet SL. For this reason, at a step in which the cutter 30 is cutting the midway position in the width direction of the long sheet SL, the first discharge roller pair 35 enters the nip state.

Also, in this embodiment, a second margin time $\alpha 2$ is set such that the first discharge roller pair 35 enters the nip state after the rotational speed of the motor for discharge 38 becomes "0 (zero)". Here, if the first discharge roller pair 35 enters the nip state at the timing when the rotational speed of the motor for discharge 38 is not yet "0 (zero)", the recorded portion SC pinched by the first discharge roller pair 35 is pulled downstream in the transport direction Y by the second discharge roller pair 36. Then, there is concern that an unnecessary stress may be applied to the recorded portion SC during cutting, so that cutting precision by the cutter 30 is lowered. In order to avoid generation of such a situation, the second margin time $\alpha 2$ is set to be a value larger than "0 (zero)".

However, if the second margin time $\alpha 2$ is set to be a too large value, other problems arise, such as the third timing t3 of stopping control of the motor for discharge 38 occurring prior to the second timing t2 when cutting of the long sheet SL by the cutter 30 is actually started. Then, the larger the value of the second margin time $\alpha 2$, the longer the period in which discharge of the recorded portion SC by the discharge unit 17 is stopped becomes. As a result, there is concern that the discharge speed of the recorded portion SC may be lowered. For this reason, in this embodiment, the second margin time $\alpha 2$ is set such that the third timing t3 takes place after the second timing t2.

In addition, a third time T3 expresses a time since control of the motor for discharge 38 is stopped and until the rotational speed of the motor for discharge 38 becomes "0 (zero)". Further, a fourth time T4 expresses a time for defining a difference in time since control of the motor for discharge 38 is stopped and until driving of the motor for pinching 37 is started. In a case where a second time T2 is less than the total time of the third time T3 and the second margin time $\alpha 2$, the fourth time T4 is set to be a time equal to a difference between the total time ($=T3+\alpha 2$) and the second time T2.

Next, a cutting processing routine among various control processing routines that the controller 67 of this embodiment executes will be described on the basis of a flowchart shown in FIG. 6 and the timing chart shown in FIG. 5. The cutting processing routine is a processing routine for executing the cutting method described using the timing chart shown in FIG. 5. Further, the cutting processing routine is executed at the timing when the recorded portion SC with an image recorded in the long sheet SL has moved further downstream than the cutting position P1 in the transport direction Y.

Now, in the cutting processing routine, the cutting control section 82 starts the driving of the motor for cutting 32 so as to move the cutter 30 which is located at the first position (or the second position) toward the second position (or the first position) (Step S10). Subsequently, the cutting control section 82 determines whether or not cutting of the long sheet SL by the cutter 30 has started (Step S11). That is, as shown in the timing chart of FIG. 5, in a case where the elapsed time from the first timing t1 when movement of the cutter 30 is started has become the time threshold Tc, the cutting control section 82 determines cutting of the long sheet SL by the cutter 30 has started (the second timing t2).

Figure 6:
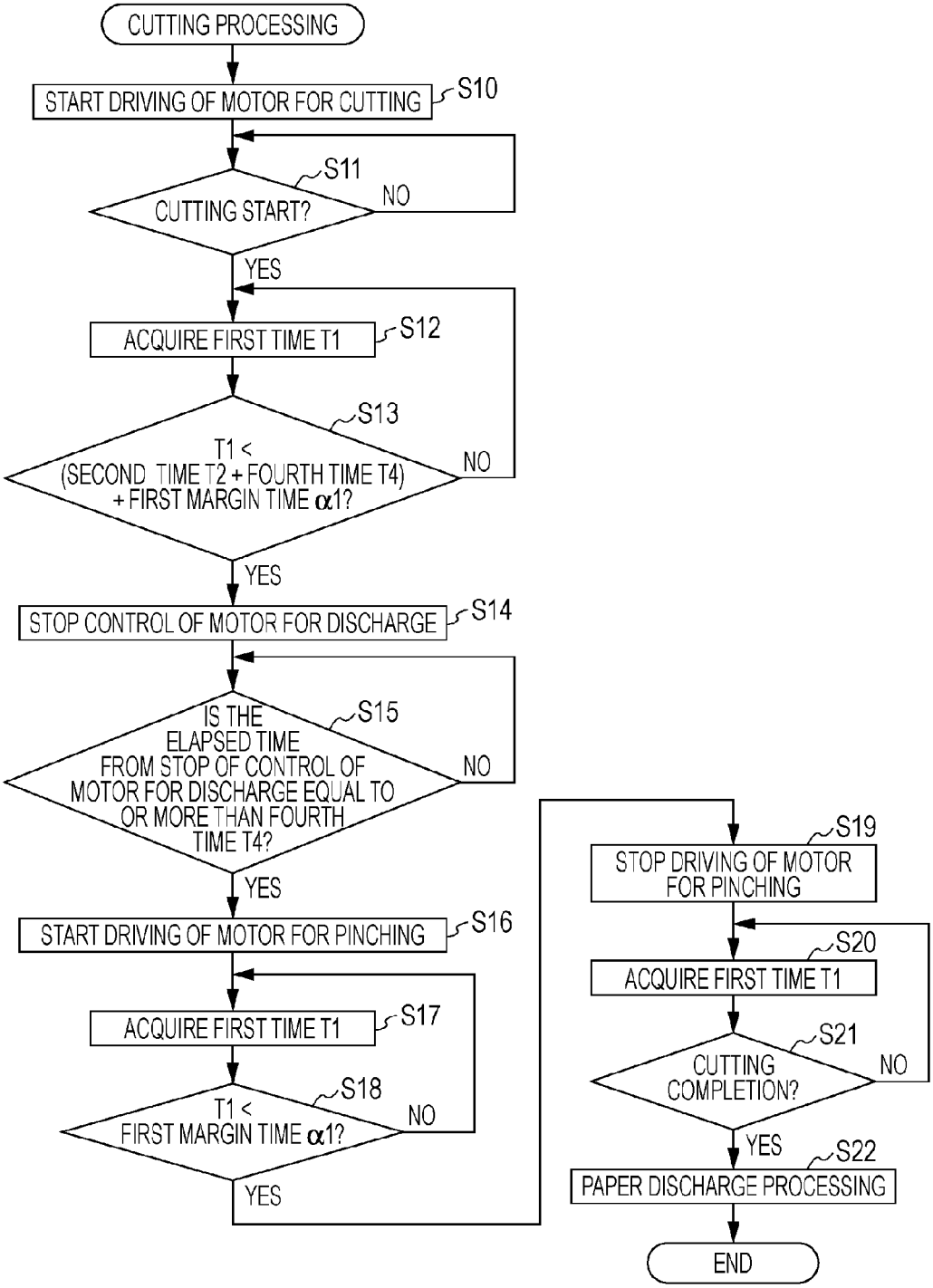
FIG. 6 is a flowchart describing a cutting processing routine.

Returning to the flowchart of FIG. 6, in a case where the determination result in Step S11 is negative, the cutting control section 82 repeatedly executes the determination processing of Step S11 until the elapsed time from the first timing t1 becomes the time threshold Tc. On the other hand, in a case where the determination result in Step S11 is affirmative, since cutting of the long sheet SL by the cutter 30 has started, the cutting control section 82 outputs the reset signal to the counter 83 and resets to the counter 83 the measurement time CT to be "0 (zero)".

Subsequently, the transport control section 84 acquires the measurement time CT from the counter 83 and then acquires a first time T1 ($=TT-CT$) which is required until cutting is completed, on the basis of the measurement time CT and the time required for cutting TT (Step S12). In addition, the time required for cutting TT is a time according to the length in the width direction of the long sheet SL and remains stored in the nonvolatile memory 65 in advance. Then, the transport control section 84 determines whether or not the first time T1 acquired in Step S12 is less than the total time of the second time T2, the fourth time T4, and the first margin time $\alpha 1$ (Step S13). That is, in Step S13, whether or not it has become the timing (the third timing t3 shown in FIG. 5) of stopping control of the motor for discharge 38 is determined. In a case where this determination result is negative ($T1 \geq (T2+T4+\alpha 1)$), since it has not become the third timing t3 shown in FIG. 5, the transport control section 84 shifts the processing to the above-described step S12. On the other hand, in a case where the determination result in Step S13 is affirmative ($T1<(T2+T4+\alpha 1)$), since it has become the third timing t3 shown in FIG. 5, the transport control section 84 stops control of the motor for discharge 38 (Step S14).

Subsequently, the transport control section 84 determines whether or not the elapsed time since control of the motor for discharge 38 was stopped has become equal to or more than the fourth time T4 (refer to FIG. 5) (Step S15). That is, in Step S15, whether or not it has become the fourth timing t4 shown in FIG. 5 is determined. In a case where the determination result is negative, since it has not become the fourth timing t4 shown in FIG. 5, the transport control section 84 repeatedly executes the determination processing of Step S15 until it becomes the fourth timing t4 shown in FIG. 5. On the other hand, in a case where the determination result in Step S15 is affirmative, since it has become the fourth timing t4 shown in FIG. 5, the transport control section 84 starts the driving of the motor for pinching 37 so as to change the first discharge roller pair 35 from the release state to the nip state (Step S16).

Then, the transport control section 84 acquires the first time T1 in the same manner as the above-described step S12 (Step S17) and then determines whether or not the first time T1 is less than the first margin time $\alpha 1$ (Step S18). That is, in Step S17 and Step S18, whether or not the first discharge roller pair 35 has entered the nip state is determined. Then, in a case where the determination result in Step S18 is negative ($T1 \geq \alpha 1$), the transport control section 84 shifts the processing to the above-described step S17. On the other hand, in a case where the determination result in Step S18 is affirmative ($T1<\alpha 1$), since the first discharge roller pair 35 has entered the nip state, the transport control section 84 stops driving of the motor for pinching 37 (Step S19). Accordingly, in this embodiment, a pinching step is constituted by Steps S16, S17, S18, and S19.

Subsequently, the transport control section 84 acquires the first time T1 in the same manner as the above-described steps S12 and S17 (Step S20). Then, the transport control section 84 determines whether or not the first time T1 acquired in Step S20 is equal to or less than "0 (zero)", in order to determine whether or not cutting has been completed (Step S21). In a case where the determination result is negative ($T1>0$), since cutting has not been yet completed, the transport control section 84 shifts the processing to the above-described step S20. On the other hand, in a case where the determination result in Step S21 is affirmative ($T1 \leq 0$), since cutting has been completed, the transport control section 84 starts the driving of the motor for discharge 38 so as to discharge the recorded portion SC cut from the long sheet SL by the cutter 30 (Step S22) and then ends the cutting processing routine. Accordingly, in this embodiment, Step S22 is equivalent to a discharge step.

According to the above embodiment, the following advantageous effects can be obtained.

(1) The recorded portion SC which is cut from the long sheet SL by the cutter 30 is pinched by the first and second rollers 35*a* and 35*b* which constitute the first discharge roller pair 35 that is located further downstream in the transport direction Y than the cutting position P1. The rollers 35*a* and 35*b* are used not only for pinching the recorded portion SC at the time of cutting of the long sheet SL by the cutter 30, but also for discharging the recorded portion SC cut from the long sheet SL. For this reason, compared to a case where a member (for example, a baffle) for pinching the recorded portion SC at the time of cutting of the long sheet SL by the cutter 30 is provided separately from a roller for discharge, an increase in the number of components of the transport device 13 can be suppressed.

(2) Further, after the cutting processing, the recorded portion SC to the discharge tray 18 side can be discharged by rotating the respective rollers 35*a* and 35*b* which pinch the recorded portion SC cut from the long sheet SL. In an existing case where the recorded portion SC is pinched by the baffle, it is necessary to discharge the recorded portion SC after pinching of the recorded portion SC by the baffle is cancelled. In contrast to this, in this embodiment, it is not necessary to cancel pinching of the recorded portion SC by the respective rollers 35*a* and 35*b*. For this reason, it is not necessary to cancel pinching by the member that pinches the recorded portion SC, so that the recorded portion SC can be rapidly discharged correspondingly.

(3) At the point of time when the other end in the width direction of the long sheet SL is cut, that is, at the point of time when the recorded portion SC is cut from the long sheet SL, a stress in the width direction is imparted to the recorded portion SC. For this reason, if the recorded portion SC does not remain pinched by the respective rollers 35*a* and 35*b* at this timing, there is concern that unintended movement of the recorded portion SC may occur due to a stress which is applied at the time of cutting. In other words, if the recorded portion SC remains pinched by the respective rollers 35*a* and 35*b* at the point of time when the recorded portion SC is cut from the long sheet SL, it is difficult for unintended movement of the recorded portion SC to occur.

Further, ink ejected from the recording head 44 remains attached to the surface of the recorded portion SC, so that from the viewpoint of quality maintenance of a recorded matter, it is preferable to make the time when the second roller 35*b* comes into contact with the surface of the recorded portion SC as short as possible. This is because in a state where ink attached to the surface of the long sheet SL has not yet dried, if a roller or the like comes into contact with the surface, there is concern that an image recorded on the sheet SL may be blurred. In this regard, in this embodiment, the timing of the start of driving of the motor for pinching 37 is adjusted such that the first discharge roller pair 35 enters the nip state while cutting the long sheet SL by the cutter 30. As a result, compared to a case where the recorded portion SC is pinched by the respective rollers 35*a* and 35*b* from before cutting of the long sheet SL by the cutter 30 is started, the contact time of the second roller 35*b* with the surface of the recorded portion SC can be shortened. For this reason, deterioration of the recording quality of the recorded portion SC recorded by the recording apparatus 11 can be suppressed.

(4) Further, in this embodiment, the motor for discharge 38 is driven so as to discharge the recorded portion SC already cut from the long sheet SL, even after cutting of the long sheet SL by the cutter 30 is actually started. Driving of the motor for discharge 38 is stopped just before the first discharge roller pair 35 enters the nip state. For this reason, compared to a case where driving of the motor for discharge 38 is stopped before cutting of the long sheet SL by the cutter 30 is actually started, it is possible to improve the discharge speed of the recorded portion SC to the discharge tray 18.

(5) Further, at the point of time when the first discharge roller pair 35 has entered the nip state, driving of the motor for discharge 38 remains stopped completely. For this reason, unlike a case where the motor for discharge 38 is still driven at the point of time when the first discharge roller pair 35 has entered the nip state, imparting of an unnecessary stress based on rotation of the motor for discharge 38 to the recorded portion SC which is cut from the long sheet SL by the cutter 30 can be avoided. As a result, it is possible to precisely cut the recorded portion SC from the long sheet SL.

(6) In a case where the recorded portion SC is cut from the long sheet SL by the cutter 30, rotation of the transport roller 23*a* remains stopped. For this reason, imparting of an unnecessary stress based on rotation of the transport roller 23*a* to the long sheet SL at the time of cutting can be avoided. Accordingly, it is possible to precisely cut the recorded portion SC from the long sheet SL.

(7) Further, at the time of cutting of the long sheet SL by the cutter 30, the sheet SL is pinched by the respective rollers 23*a* and 23*b* of the transport roller pair 23. For this reason, when the recorded portion SC is cut from the long sheet SL, even if a stress has been imparted to the sheet SL, unnecessary movement of the sheet to the scanning direction X can be suppressed.

(8) In the recording apparatus 11 provided with the transport device 13 of this embodiment, it is possible to rapidly discharge the recorded portion SC cut from the long sheet SL. Accordingly, the throughput of the recording apparatus 11 can be improved.

In addition, the above embodiment may be changed as follows without departing from the scope of the claims.

The transport roller pair 23 may also be disposed between the recording unit 14 and the cutting point P1 in the transport direction Y.

Provided that the timing of stopping driving of the motor for discharge 38 is set to be equal to the timing when cutting of the long sheet SL by the cutter 30 is actually started, or after the timing, the fourth time T4 may also be set to be a value larger than a difference (=(T3+$\alpha$2)−T2) between the total time of the third time T3 and the second margin time $\alpha$2 and the second time T2.

In a case where the second margin time $\alpha$2 is set such that the second time T2 becomes equal to or more than the total time of the third time T3 and the second margin time $\alpha$2, the fourth time T4 may be set to be "0 (zero)". In this case, the timing of starting driving of the motor for pinching 37 so as to make the first discharge roller pair 35 which is in the release state, be in the nip state, is made to correspond with the timing of stopping driving of the motor for discharge 38, or earlier than the timing.

The second margin time $\alpha$2 may be set to be "0 (zero)". In this case, the timing when the rotational speed of the motor for discharge 38 becomes "0 (zero)" is made to approximately correspond with the timing when the first discharge roller pair 35 enters the nip state.

The timing when the first discharge roller pair 35 which is in the release state enters the nip state may also be made to correspond with the second timing t2 when cutting of the long sheet SL by the cutter 30 is actually started. Further, the timing when the first discharge roller pair 35 which is in the release state enters the nip state may also be made to correspond with the first timing t1 when driving of the motor for cutting 32 is started. However, it is preferable to make the rotational speed of the motor for discharge 38 "0 (zero)" before the first discharge roller pair 35 enters the nip state. Even when configured in this manner, since, just before the recorded portion SC is cut from the long sheet SL, the recorded portion SC is pinched by the first discharge roller pair 35, generation of unnecessary movement of the cut-off recorded portion SC can be suppressed.

Provided that it is a shape which can cut the long sheet SL at the time of movement from the first position to the second position and the time of movement from the second position to the first position, the shape of the cutter 30 may also be an arbitrary shape. For example, the cutter 30 may also have an approximately rectangular shape.

Provided that it is a configuration in which the first roller 35*a* and the second roller 35*b* can relatively move in a direction in which they approach each other and a direction in which they are separated from each other, the first discharge roller pair 35 may also have a configuration in which the first roller 35*a* moves in a direction in which it approaches the second roller 35*b* and a direction in which it is separated from the second roller 35*b*. Also, the first discharge roller pair 35 may have a configuration in which all of the first roller 35*a* and the second roller 35*b* can move in the up-and-down direction in FIG. 1.

In the case of discharging the recorded portion SC cut from the long sheet SL, the first discharge roller pair 35 may also be set to be in the release state at the timing when the recorded portion SC is pinched by the second discharge roller pair 36.

The cutting position P1 may also be disposed further upstream in the transport direction Y than the recording head 44. In this case, the recording unit 14 carries out recording with respect to the downstream portion cut from the long sheet SL.

The recording unit 14 may also be embodied in a so-called lateral type recording unit in which ink is ejected from the recording head 44 while moving the carriage 41 in the transport direction Y. Further, the recording unit 14 may also be embodied in a so-called line head type recording unit in which the recording head 44 does not move during recording processing.

Provided that it is a medium capable of being cut by the blade section such as the cutter 30, the medium may also be an arbitrary medium such as cloth, a resin film, a resin sheet, or a metal sheet.

The recording apparatus 11 may also be embodied in a fluid ejecting apparatus in which fluid other than ink is ejected or discharged. Further, the recording apparatus 11 may also be embodied in various liquid ejecting apparatuses which are each provided with a liquid ejecting head or the like that discharges a minutely small amount of liquid droplets. In this case, the liquid droplet means a liquid in a state of being discharged from the above liquid ejecting apparatus and also includes droplets of a granular shape or a tear shape, or droplets tailing into a line. Also, it is acceptable if the liquid as mentioned herein is a material that can be ejected by a liquid ejecting apparatus. For example, it is acceptable if the liquid is a substance in a state when it is a liquid phase, and the liquid includes not only liquids in a liquid state with high or low viscosity, a flow state such as sol, gel water, other inorganic or organic solvents, a solution, a liquid resin, or a liquid metal (metal melt), and one state of substance, but also a material in which particles of a functional material composed of a solid material such as pigment or metal particles are dissolved, dispersed, or mixed in a solvent, or the like. Also, ink as described in the above-described embodiments, a liquid crystal, or the like can be given as representative examples of the liquid. Here, ink is set to include general water-based ink and oil-based ink and various liquid compositions such as gel ink or hot-melt ink. As a specific example of the liquid ejecting apparatus, a liquid ejecting apparatus that ejects liquid that includes, in a dispersed or dissolved form, a material such as an electrode material or a color material, which is used for the manufacturing or the like of, for example, a liquid crystal display, an EL (electroluminescence) display, a surface-emitting display, or a color filter, can be given. Further, the liquid ejecting apparatus may be a liquid ejecting apparatus that ejects a biological organic matter that is used for the manufacturing of biochips, a liquid ejecting apparatus that is used as a precision pipette and ejects liquid that is a sample, a cloth printing apparatus, a micro-dispenser, or the like. Then, the invention can be applied to any type of liquid ejecting apparatus among these liquid ejecting apparatuses. Further, the fluid may be a powder granular material such as toner.

In addition, the fluid as mentioned in this specification is set not to include a material composed of gas only. Also, the recording as mentioned in this specification is not limited to printing on a sheet such as paper, but is a concept that includes formation of a circuit by recording by adhering ink (or paste) prepared by a material for an element or a wiring onto a substrate (recording medium) when manufacturing, for example, an electric circuit.

The recording apparatus 11 may also be a recording apparatus which carries out recording on a medium by another recording method such as a dot impact method or a laser method.

Next, the technical idea that can be grasped from the above embodiment and other embodiments will be additionally described below.

(A) A transport device in which the transport section further includes a driven roller which rotates following the rotation of the transport roller and pinches the medium along with the transport roller, and the transport roller is disposed at one side of the bottom surface and the top surface of the medium and the driven roller is disposed at the other side of the bottom surface and the top surface of the medium.

What is claimed is:

1. A transport device comprising:

a cutting section which cuts a medium that is transported along a transport direction;

a discharge section which discharges a downstream portion cut from the medium by the cutting section downstream in the transport direction; and a transport control section which controls the cutting section and the discharge section, wherein the discharge section includes a first roller which is disposed at the bottom surface of the medium, a second roller which is disposed at the top surface of the medium, a driving source which generates a driving force for relatively moving the respective rollers in a direction so as to make the respective rollers approach each other and a direction of making the respective rollers separate from each other, and a motor for discharge which generates a driving force for rotating the respective rollers that are in the approached state, and wherein the transport control section:

controls, at the time of after the cutting of the medium by the cutting section has started, the driving source such that the respective rollers are moved from the separated state to approach each other after the start of movement of a blade section, such that the downstream portion which is cut from the medium remains pinched by the respective rollers at the point of time of the completion of cutting, and controls the motor for discharge such that the downstream portion is discharged downstream in the transport direction by rotation of the respective rollers which pinch the downstream portion, after the completion of cutting.

2. The transport device according to claim 1, wherein the cutting section includes the blade section which moves from one end in the width direction of the medium to the other end, thereby cutting the medium, and wherein the transport control section controls, at the time of cutting of the medium by the cutting section, the driving source such that pinching of the downstream portion by the respective rollers is completed at the point of time when a midway position which is between one end in the width direction of the medium and the other end is cut by the blade section.

3. The transport device according to claim 1, wherein the transport control section adjusts, at the time of cutting of the medium by the cutting section, the timing of the stop of control of the motor for discharge and the timing of the start of control of the driving source such that rotation of the first roller is stopped before pinching of the downstream portion by the respective rollers is completed.

4. The transport device according to claim 3, wherein the transport control section controls, at the time of cutting of the medium by the cutting section, the driving source such that relative movement of the respective rollers that are in the separated state in a direction of approaching each other is started at the point of time when control of the motor for discharge is stopped or after that point of time.

5. The transport device according to claim 1, further comprising: a transport section which includes a transport roller that is disposed further upstream in the transport direction than a cutting position by the cutting section in the medium transport direction and a transport motor which generates a driving force for rotating the transport roller, wherein the transport control section controls the transport motor, at the time of cutting of the medium by the cutting section, such that rotation of the transport roller is stopped before the start of driving of the cutting section and the transport roller rotates so as to restart transport of the medium, after the completion of cutting.

6. A recording apparatus comprising:

the transport device according to claim 1;

a recording section which attaches fluid to the medium; and a recording control section which controls the recording section so as to stop recording processing using the fluid, at the time of cutting of the medium by the cutting section.

7. A recording apparatus comprising:

the transport device according to claim 2;

a recording section which attaches fluid to the medium; and a recording control section which controls the recording section so as to stop recording processing using the fluid, at the time of cutting of the medium by the cutting section.

8. A recording apparatus comprising:

the transport device according to claim 3;

a recording section which attaches fluid to the medium; and a recording control section which controls the recording section so as to stop recording processing using the fluid, at the time of cutting of the medium by the cutting section.

9. A recording apparatus comprising:

the transport device according to claim 4;

a recording section which attaches fluid to the medium; and a recording control section which controls the recording section so as to stop recording processing using the fluid, at the time of cutting of the medium by the cutting section.

10. A recording apparatus comprising:

the transport device according to claim 5;

a recording section which attaches fluid to the medium; and a recording control section which controls the recording section so as to stop recording processing using the fluid, at the time of cutting of the medium by the cutting section.

11. A transport method comprising:

cutting a downstream portion of a medium using a cutting section while a first roller which is disposed at the bottom surface of the medium and a second roller which is disposed at the top surface of the medium are in a separated state, then causing the first roller and second roller to relatively move in a direction so as to approach each other from the separated state after the cutting by the cutting section has started, such that the downstream portion which is cut from the medium remains is pinched by the respective rollers, which are disposed downstream in the transport direction from the cutting section, at the point of time of the completion of cutting; and discharging the downstream portion downstream in the transport direction by rotation of the respective rollers which pinch the downstream portion, after the completion of cutting.

12. A recording method comprising:

performing a recording process on a medium using a recording section which attaches fluid to the medium;

cutting a downstream portion of a medium using a cutting section while a first roller which is disposed at the bottom surface of the medium and a second roller which is disposed at the top surface of the medium are made to relatively move in a direction so as to approach each other from a separated state, such that the downstream portion which is cut from the medium remains pinched by the respective rollers, which are disposed downstream in the transport direction from the cutting section, at the point of time of the completion of cutting; and discharging the downstream portion downstream in the transport direction by rotation of the respective rollers which pinch the downstream portion, after the completion of cutting, wherein the recording section is controlled by a recording control section so as to stop the recording process at the time of cutting of the medium by the cutting section.

* * * * *